United States Patent [19]

Soltus et al.

[11] Patent Number: 4,559,762

[45] Date of Patent: Dec. 24, 1985

[54] METHOD FOR LOADING ELECTRON TUBES IN PACKAGES

[75] Inventors: Michael Soltus, Forest City; James G. Reese, Jr., Clarks Summit, both of Pa.

[73] Assignee: RCA Corporation, Princeton, N.J.

[21] Appl. No.: 525,420

[22] Filed: Aug. 22, 1983

[51] Int. Cl.[4] ..... B65B 23/22; B65B 5/08; B65B 5/10

[52] U.S. Cl. ..... 53/441; 53/449; 53/475

[58] Field of Search ..... 53/472, 475, 473, 441, 53/442, 390, 446, 246, 453, 142, 449, 144; 206/419, 422, 592, 523; 248/131, 425; 211/78, 163; 414/223

[56] References Cited

U.S. PATENT DOCUMENTS

| | | | |
|---|---|---|---|
| 1,580,163 | 4/1926 | Peterson et al. | 248/131 X |
| 3,031,821 | 5/1962 | Erwin, Jr. et al. | 53/142 X |
| 3,201,911 | 8/1965 | Woodland | 53/472 X |
| 3,227,357 | 1/1966 | Knapp et al. | 229/39 |
| 3,311,225 | 3/1967 | Kidd | 211/78 X |
| 3,330,407 | 7/1967 | Graves et al. | 206/65 |
| 3,358,902 | 12/1967 | Emmert et al. | 53/441 X |
| 3,363,753 | 1/1968 | Taylor | 206/65 |
| 3,396,507 | 8/1968 | Morris et al. | 53/142 |
| 3,435,589 | 4/1969 | Horton | 53/390 |
| 3,583,559 | 6/1971 | Brander | 206/422 |
| 3,600,871 | 8/1971 | Farquhar | 53/441 X |
| 3,618,290 | 11/1971 | Delme | 53/142 |
| 3,721,063 | 3/1973 | Weimer | 53/390 |
| 3,910,411 | 10/1975 | Deeren | 206/422 |
| 4,088,225 | 5/1978 | Hartnell | 206/419 |
| 4,241,830 | 12/1980 | DiGesu' | 206/422 |
| 4,278,170 | 7/1980 | Nauheimer | 206/422 |
| 4,294,358 | 10/1981 | Nauheimer et al. | 206/419 |
| 4,294,359 | 10/1981 | Berkel | 206/422 |
| 4,391,371 | 7/1983 | Sieffert | 206/419 X |

FOREIGN PATENT DOCUMENTS

| | | | |
|---|---|---|---|
| 332023 | 1/1956 | Switzerland | 53/472 |

*Primary Examiner*—Horace M. Culver

*Attorney, Agent, or Firm*—Eugene M. Whitacre; Dennis H. Irlbeck; LeRoy Greenspan

[57] ABSTRACT

A tube packaging method comprises (a) providing a base platform having a radial array of nests, each adapted for receiving an electron tube, (b) positioning the platform with an empty one of the nests in a prescribed position, (c) loading an electron tube into the nest, (d) rotating the platform about a center to position another empty nest in the prescribed position, and (e) loading another electron tube into another nest.

11 Claims, 7 Drawing Figures

METHOD FOR LOADING ELECTRON TUBES IN PACKAGES

BACKGROUND OF THE INVENTION

This invention relates to a novel method for loading electron tubes, particularly television picture tubes and data display tubes for data terminals, in packages.

After electron tubes are fabricated, they are usually loaded into packages and shipped to the receiver or terminal factory for installation into cabinets and connection to operative circuits. Television picture tubes and data display tubes usually have a funnel-shaped portion with the wide end closed by a faceplate panel and the narrow end closed by a neck and base. Packages for such tubes include a base platform or deck having nests therein for receiving a portion of each of several tubes. The tubes are loaded into the nests by hand, requiring the operator to rotate and position the tube above each nest manually and then drop or roll it into the nest. Also, because of the width of the platform, the operator must reach out beyond the nearest tube to load the more distant nests. Considering that the tubes are quite heavy, weighing about 9 to 23 kilograms (about 20 to 50 pounds), it is desirable to reduce the effort required of the loading operator. Also, the prior art method of loading the tubes into the nests is difficult to automate because each of the tubes is required to be in a different position and orientation.

The novel method of loading tubes can be practiced either manually or by machine, and can be shifted from one of these modes to the other. Also, by the novel method the biomechanics is simplified, thereby making fewer demands on both human and machine loader. Packages that were placed by the novel method can be unpacked (unloaded) in a simplified manner either manually or by machine.

SUMMARY OF THE INVENTION

In the novel method, as in prior methods, a base platform is provided having at least four nests for receiving an equal number of tubes. The nests in the provided base platform are in a radial array about a center and are arranged so that when the base platform is filled, all of the bases of the tubes face inwardly towards the center.

The novel method includes positioning the base platform with an empty one of the nests in a prescribed position, loading the nest with a tube, rotating the base platform about its center to position another empty one of the nests in the prescribed position, and loading another tube into another nest. These last two steps may be repeated until all of the nests are filled. All tubes, when being loaded, are brought to the same orientation and position, thus requiring less judgment and less effort by a human operator and simpler programming and lighter machinery for automatic loading.

After the base platform is fully loaded, it may be closed as in prior loading methods. It is preferred, however, that the nests cradle less than half the height of the tubes, and that a cover platform, having substantially complementary recesses with respect to the nests in the base platform, is positioned over and seated on the loaded tubes. To complete the package, plastic sheet material is wrapped around and overlaps substantial portions of the sides of both the base platform and the cover platform. The package may now be moved as a unit and may be stacked on another package. The package may be unloaded by carrying out the foregoing steps in reverse order.

BRIEF DESCRIPTION OF THE DRAWINGS

FIGS. 4 and 5 are views from section lines 4—4 and 5—5 respectively of FIG. 3.

DETAILED DESCRIPTION OF THE PREFERRED EMBODIMENT

Figure 1:
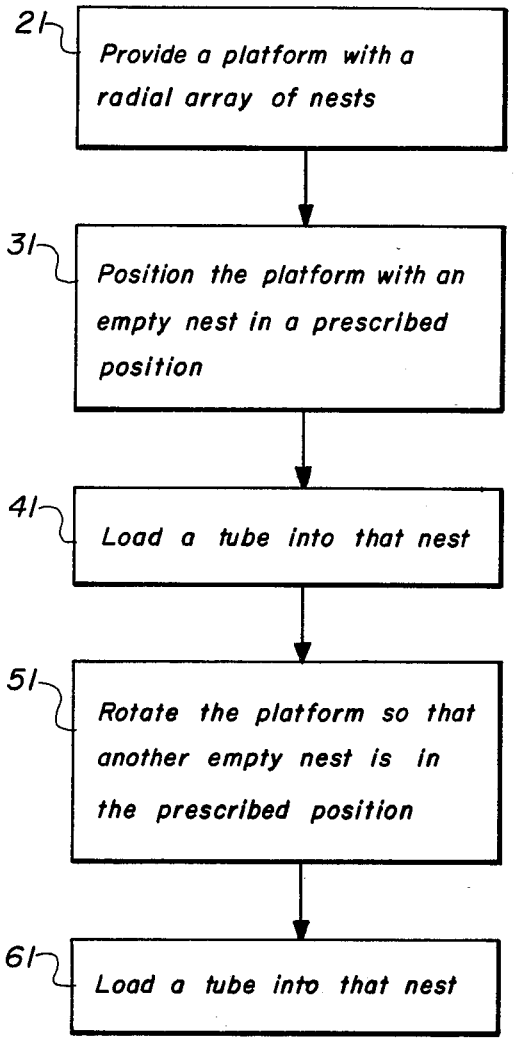
FIG. 1 is a flow diagram illustrating graphically the novel method.

The novel method can be described in a broad sense by reference to FIG. 1. As a first step shown by the first box 21, a base platform is provided having a radial array of nests for receiving a corresponding number of electron tubes, each such as television picture tubes or data display tubes. Such a tube has a longitudinal axis which extends through the tube base and the viewing window of the tube. The base platform has nests, which are openings or recesses therein for receiving a portion of one tube in each nest with the longitudinal axes of the tubes in a plane, or a near plane, and radiating outwardly from a central area of the platform.

Figure 2:
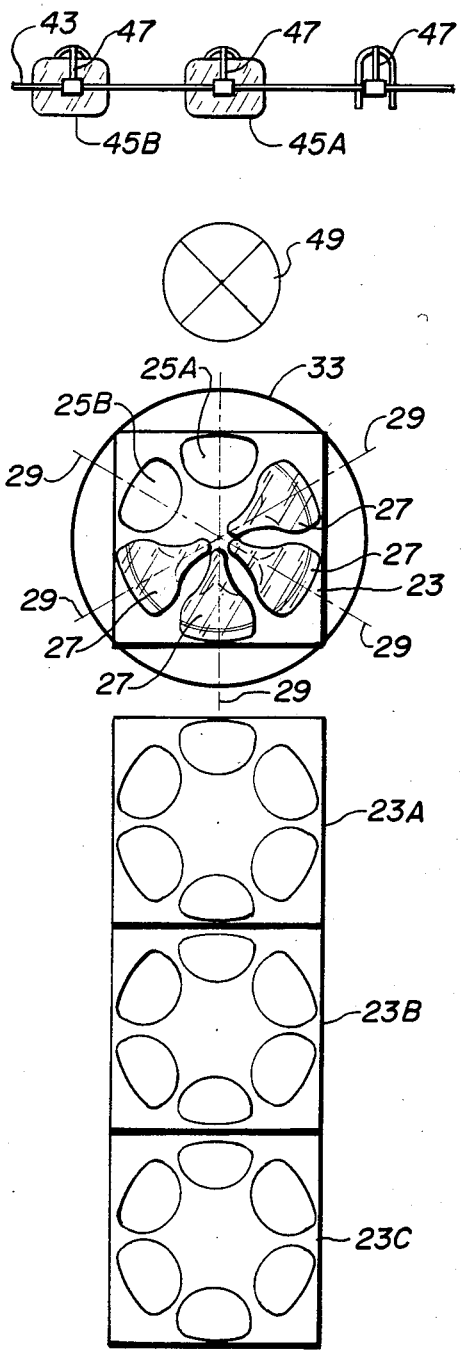
FIG. 2 is a schematic plan view of a system for practicing the novel method.

FIG. 2 shows such a base platform 23 for holding six picture tubes. Two nests 25A and 25B are unfilled, and four nests are filled with tubes 27. The axes 29 of the tubes all intersect at the center of the base platform 23, although the axes need not all intersect at the same point. Because of this radial arrangement, the packaging herein is referred to as a "pinwheel pack."

The platform may be made of corrugated board, vacuum-formed plastic, injection-molded plastic, expanded foam plastic or any other material that can be used to prepare shipping containers. Where the platform is made of sheet material, such as corrugated board, the nests are cutouts and folded material as is known in the art. Where the platform is made of formed or molded material, the nests are shaped cavities that generally conform to the shape of the tubes. Any number of nests can be present in the platform. However, fewer than four nests and greater than eight nests are believed to be uneconomical in practice, particularly where the tubes are bulky and heavy.

Referring again to FIG. 1, the next step, shown by the second box 31, is to position the platform with an empty nest in a prescribed position. In FIG. 2, the base platform 23 rests on a rotatable table 33 that can be indexed around the center thereof. As shown in FIG. 2, the nest 25A is in the prescribed position for loading. Because of the radial arrangement, each nest can be indexed by rotation to the same prescribed position (location and orientation) so that each tube to be loaded need only be brought to the same position (location and orientation).

The third box 41 of FIG. 1 provides that a tube is loaded into the nest that is in the prescribed location. In FIG. 2, the nest 25A is the nest to be loaded. An overhead conveyor 43 brings a series of tubes 45A, 45B, etc. on carriers 47 to a loader 49, who or which transfers a succession of tubes to a succession of nests. The loader 49 can be a human, a robot or a transfer machine. As shown in FIG. 2, the tubes arrive on the conveyor 43 with their windows facing up and their base down. The loader 49 removes a tube 45A from the conveyor, rotates the tube 90° so that the longitudinal axis thereof is substantially horizontal, and then translates the tube to the nest 25A in the prescribed position.

The fourth box 51 of FIG. 1 provides that the platform is rotated so that another empty nest is in the prescribed position. As shown in FIG. 2, the table 33 is indexed around in a clockwise direction carrying the platform 23 with it, so that the second nest 25B will be where the first nest 25A is as shown. As shown, the table 33 and platform 23 index clockwise so that a succession of adjacent nests is brought to the prescribed position, but the indexing can be either clockwise and/or counter clockwise, and the nests can be brought to the prescribed position in any order. Where the tubes are bulky or heavy, for example, it may be desirable to have a different loading order than that shown in FIG. 2. Loading every other nest may be particularly desirable where the platform has an odd number of nests.

The fifth box 61 shown in FIG. 1 provides that another tube be loaded into the second nest 25B, which is now in the prescribed position. This is done by the loader 49 in the identical manner shown by the third box 41 with the next tube, such as the tube 45B.

In prior loading methods, the base platform remained stationary and the loader had to find the desired nest for loading and then orient each tube, and position it separately and differently, to each nest. This required much more information, judgment, and capability by the loader, both human and/or mechanical. Furthermore, in many cases, the loader had to reach over a nest, filled or empty, to fill a more remote nest. With heavy, bulky tubes, this frequently strained the loader unduly. Reaching-over is avoided by the novel method.

After the base platform is loaded, a cover platform (not shown in FIGS. 1 or 2) is positioned over the loaded tubes. The cover platform is similar in design to the base platform, having similar mirror-image cutouts or recesses to that of the base platform, and will seat on and over the loaded tubes. The base and cover platforms may be wrapped with sheet plastic or may be provided with an outer protective sleeve to cover the space between the platform and to protect the tubes therebetween. The loaded base platform 23 shown in FIG. 2 is lifted from the table 33, as with a fork lift, and stored or shipped as desired. Another base platform 23A, from a series 23A, 23B, 23C, etc., is transferred from a roller conveyor to the table 33.

Figure 3:
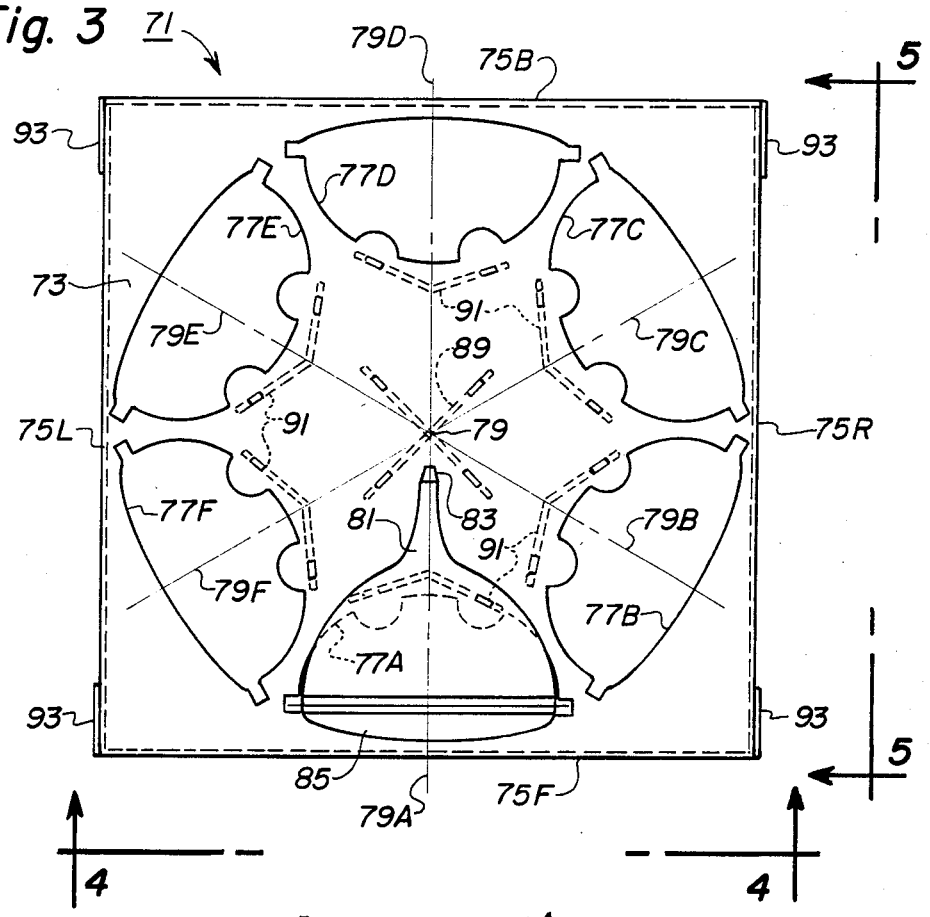
FIGS. 3, 4 and 5 are respectively plan, fragmental front and fragmental side views of a platform loaded with one tube according to the novel method.
Figure 4:
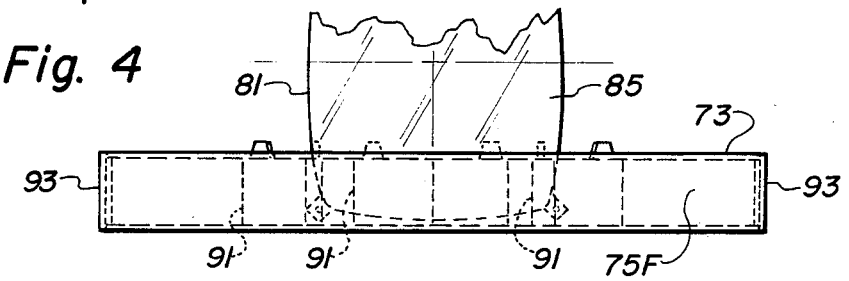
Figure 5:
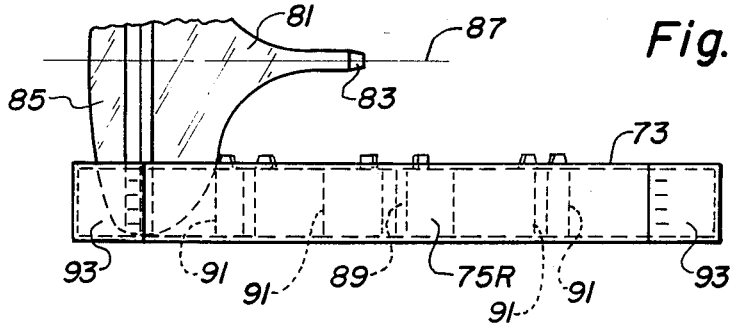

A particular base platform 71 made of corrugated fiber board is shown in FIGS. 3, 4 and 5. The base platform is comprised of a deck 73 and four sidewalls 75F, 75L, 75B and 75R folded down along the periphery of the deck 73. The deck 71 has six cutouts 77A through 77F of substantially identical shape, each cutout being symmetrically disposed about a corresponding centerline 79A through 79F. The centerlines extend radially from a center or central point 79, and are equiradially spaced. Each cutout 77A and 77F forms a nest for receiving and supporting a tube.

FIGS. 3, 4 and 5 show a single television picture tube 81 loaded in the one cutout 77A, with the base 83 of the tube 81 facing towards the central point 79, the window 85 of the tube facing towards the sidewall 75F of the platform, and the longitudinal axis 87 (FIG. 5) of the tube 81 substantially parallel to the centerline 79A (FIG. 3) of the cutout 77A. The cutout 77A is not identically shaped to the tube 81, but is of such shape as to support the weight of the tube. The weight of most television tubes is in the range of 10 to 25 kilograms (22 to 55 pounds). In this example, the tube 81 is a 19 V tube weighing about 15 kilograms (33 pounds). Additional corrugated supports that are provided under the deck 73 to carry the weight of six tubes include a central "X-shaped" support 89, a "V-shaped" support 91 under each tube, and a reinforcement 93 at each corner. When the tube 81 is supported in the nest formed by the cutout 77A, less than a quarter of the height of the tube 81 is in the nest. The rest of the tube, including the neck and base 83, is above the deck 73. A cover platform, not shown, has an identical arrangement of cutouts. Since the cutouts are identical in shape and are arranged symmetrically, the cover platform or another base platform can be placed over and seated on the tubes that are loaded in the base platform. This type of platform does not have legs and therefore needs to be on a suitable pallet for fork-lift loading.

Figure 6:
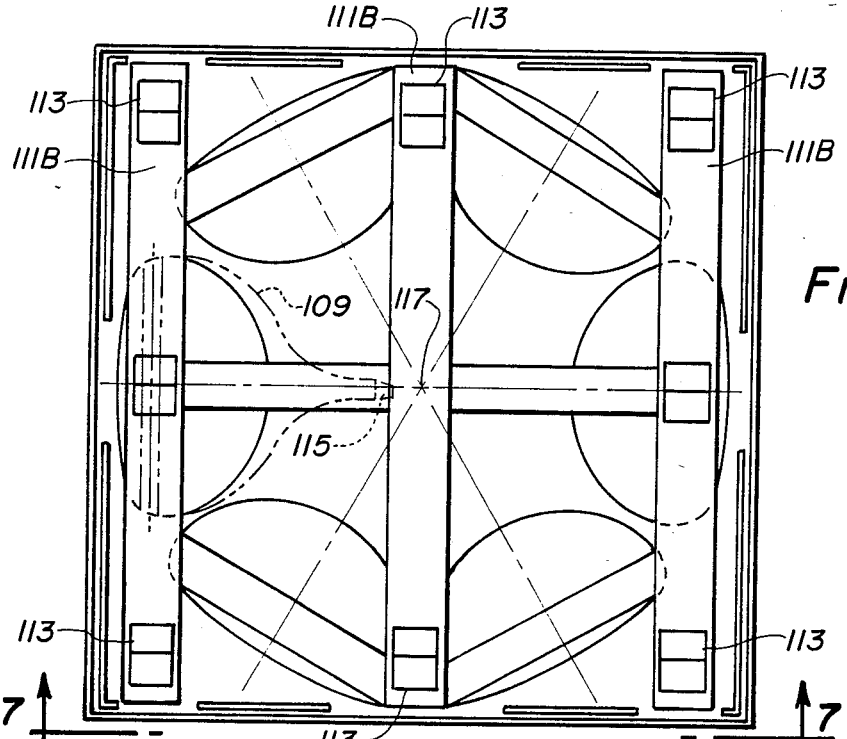
FIG. 6 is a plan view of a stack of two platforms fully loaded according to the novel method.
Figure 7:
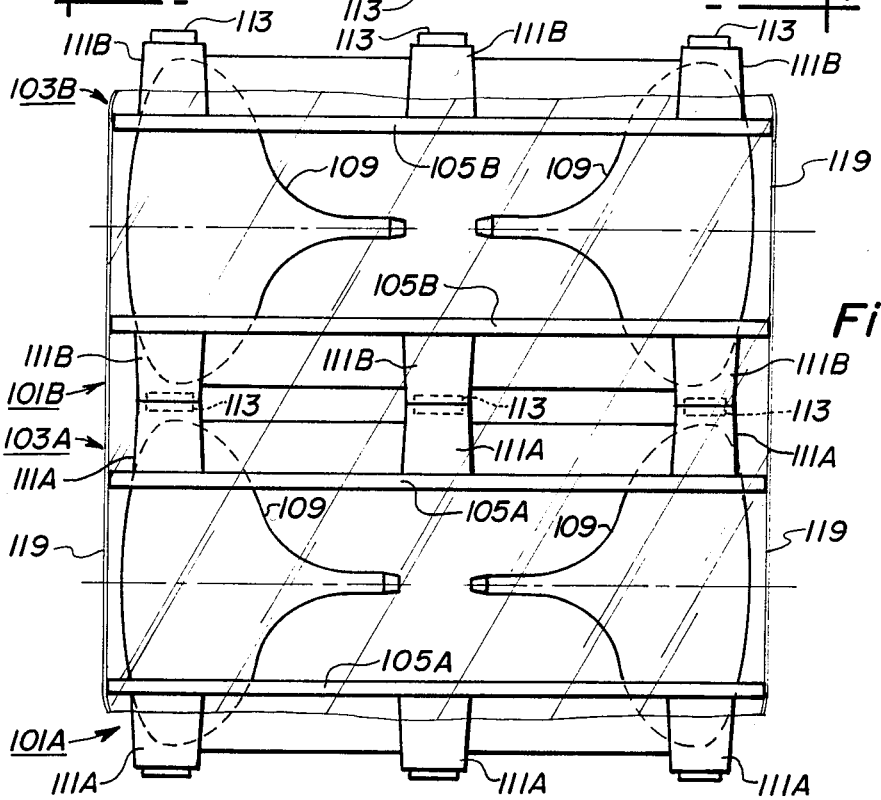
FIG. 7 is a side elevational view of the stack shown in FIG. 6 viewed from section line 7—7.

Another particular type of base platform made of molded polystyrene plastic is shown in FIGS. 6 and 7. Also, shown are cover platforms that are identical in design to the base platforms. The base platforms 101A and 101B each have a deck 105A and 105B respectively with six cavities therein, radially-disposed as in FIG. 3, and each is so shaped as to be adapted for receiving and supporting a picture tube 109 therein. The outline of a tube 109 is shown in phantom lines in FIG. 6, showing that each tube is positioned with its base 115 towards a central point 117. Also molded into the platform is a plurality of legs 111A and 111B having recessed patterns 113 (patterns not shown) at the bottoms thereof for interlocking with corresponding recesses in the leg bottoms of a cover platform.

FIGS. 6 and 7 show two base platforms 101A and 101B each loaded with six tubes 109 and each having a cover platform 103A and 103B respectively seated thereon. One base platform 101B is supported on the bottoms of the legs 111A of a cover platform 103A below. The clearance between the legs 111A under the deck 105A is sufficient to allow a fork lift to slide in and out. Furthermore, the underside of the deck 105A is designed to receive a fork lift, and the platform is designed to support a fully-loaded platform when loaded in this manner. In FIG. 7, in order to simplify the drawing, the two front tubes and the two back tubes have been removed, and only the tubes 109 facing left and right as viewed are shown. A clear plastic sheet 119 is stretch wrapped twice around the two lower decks 105A and then diagonally upward, twice around, and then twice around the two upper decks 105B. The plastic wrapping holds to itself and binds the stack of two packages so that it can be handled as a unit. With or without wrapping, stacks of eight packages high have been found to be stable in the warehouse. In place of wrapping, the packages can be banded with two strapping bands around the spaces between the legs of the platform.

What is claimed is:

1. A method for loading electron tubes in a package containing m tubes wherein m is at least 4, said method including (a) providing a base platform having m nests therein for receiving said m tubes in a radial array about a center with all of the bases of said tubes facing inwardly towards said center, each of said nests for holding less than half the height of said tubes, (b) positioning said base platform with an empty one of said nests in a prescribed position, (c) loading an electron tube into said one nest, (d) rotating said base platform about said center to position another empty one of said nests in said prescribed position, (e) loading another electron tube into said another one of said nests, (f) repeating steps (d) and (e) until all of said nests are filled, (g) providing a cover platform having m recesses therein substantially complementary to said m nests in said base platform, and (h) positioning said cover platform over said loaded tubes with less than half the height of each tube within one of said recesses, said cover platform being spaced from said base platform by said loaded tubes.

2. The method defined in claim 1 wherein said electron tubes are cathode-ray tubes of the type having a funnel-shaped portion with the narrow end thereof towards said base.

3. The method defined in claim 2 wherein the value of m is an integer in the range of 4 to 8.

4. The method defined in claim 1 including wrapping plastic sheet material around and overlapping substantial portions of the sides of both of said base platform and said cover platform.

5. A method for packing cathode-ray tubes in packages containing m tubes, wherein m is an integer in the range of 4 through 8, said tubes being of the type comprising a funnel having a wide end and a narrow end, said method including the steps of (a) providing a base platform having m nests for receiving said tubes in a radial array about a center with all of said wide ends facing outwardly and all of said narrow ends facing inwardly towards said center, and each nest having a capacity for holding less than half the volume of a tube to be loaded therein, (b) positioning said platform with an empty one of said nests in a prescribed position, (c) loading a tube into said one nest, (d) rotating said platform about said center to position another nest in said prescribed position, (e) loading another tube in said another nest, (f) repeating steps (d) and (e) until all of said nests are filled, (g) providing a cover platform having recesses therein that are substantially identical to, except that they are the mirror image of, said nests in said base platform, and (h) seating said cover platform on said m tubes in said base platform with less than half the volume of each tube within one of said recesses, said cover platform being spaced from said base platform by said loaded tubes.

6. The method defined in claim 5 wherein, at steps (d) and (f), said another nest is adjacent the nest loaded just prior thereto.

7. The method defined in claim 5 wherein m is an odd integer, and, at steps (d) and (f), said another nest is not adjacent the nest loaded just prior thereto.

8. The method defined in claim 5 wherein m is 6.

9. The method defined in claim 5 wherein the centerlines of said tubes, when extended inwardly, intersect at said center of said platform.

10. The method defined in claim 5 including the step of stretch wrapping plastic sheet material around and overlapping a substantial portion of the sides of both said base platform and said cover platform, thereby producing a packed package of tubes.

11. The method defined in claim 5 including the steps of repeating steps (a) through (h) to produce another package of tubes, and stacking one of said packages on the other of said packages.

* * * * *